United States Patent [19]

Reiff

[11] 4,312,130

[45] Jan. 26, 1982

[54] DRAFTING INSTRUMENT

[76] Inventor: Evan J. Reiff, 5173 Brighton Ave., #6, San Diego, Calif. 92107

[21] Appl. No.: 95,236

[22] Filed: Nov. 19, 1979

[51] Int. Cl.[3] ..... B43L 13/00

[52] U.S. Cl. ..... 33/18 R

[58] Field of Search ..... 33/18 R, 23 D, 27 B; 401/48

[56] References Cited

U.S. PATENT DOCUMENTS

| | | | |
|---|---|---|---|
| 556,302 | 3/1896 | Carver et al. | 401/48 |
| 2,362,992 | 11/1944 | Dentzler | 401/48 |
| 2,735,178 | 2/1956 | Adams | 33/18 R X |
| 2,748,474 | 6/1956 | Brown | 33/18 R X |
| 2,810,960 | 10/1957 | Johnson et al. | 33/18 R |
| 2,934,452 | 2/1946 | Howard | 401/48 |
| 3,089,246 | 5/1963 | Riepe | 33/27 B |
| 3,094,784 | 6/1963 | Van Dyke | 33/18 R X |
| 3,396,469 | 8/1968 | Brott | 33/23 D |
| 3,853,411 | 12/1974 | Cirado | 401/48 |

*Primary Examiner*—Charles E. Phillips
*Attorney, Agent, or Firm*—Arthur F. Holz

[57] ABSTRACT

A holder for modern drafting pens is described consisting of a grasping handle and platform supported at three points, two of the supports being friction glide feet and the third point being the end tip itself which is connected to the platform via an adaptor plate containing a threaded hole which engages the threads on the barrel of the pen.

1 Claim, 3 Drawing Figures

DRAFTING INSTRUMENT

BACKGROUND OF THE INVENTION

The art of technical drafting demands precision and accuracy often beyond the levels achievable by unaided freehand drawing. Many specialized drawing instruments and pens have been developed to aid the draftsman to produce steady, straight and clear lines of uniform width and ink density. For these purposes it is desirable that the inkpen be held steady during the drawing process and necessary that the pen be held at a constant angle to the paper. Devices for stabilizing pens are also useful for and sometimes specifically developed for aiding physically handicapped persons to write and draw in spite of restricted dextrity. Examples in the art are U.S. Pat. Nos. 2,362,992 and 2,178,755, both of which indeed steady the drafting pen and hold it substantially vertical relative to the paper surface. The devices in the art, including those cited, however, are of limited utility for precision drafting in that the pen is commonly supported a significant distance above the contact point of the pen nib on the paper, and this distance reduces the ability of the support to steady the pen tip. Further, the devices in the art can be cumbersome where there is no means to readily adjust the contact of the pen to the paper by varying the pressure to produce desirable effects such as varying the line width. Finally, a number of the devices in the art while steadying the pen also surround it to the point that it is difficult for the draftsman to view the pen nib to paper contact point until the instrument is removed from the area being drawing upon.

SUMMARY OF THE INVENTION

The device described herein is an improved penholder developed for use with modern technical fountain pens of the type which use a narrow, tubular, needle-like pen nib to contain the ink flow medium. These pens usually have a threaded barrel near the pen tip for retaining a small cap on the pen and the within invention uses these same male threads on the pen barrel for rigidly holding the pen in a vertical position relative to the paper. The device of course could be used with any pen with screw threads on the barrel, but is particularly useful for the modern tubular nib pens because of the desirability of a vertical orientation when drawing with such pens.

Verticality is necessary for maintenance of proper line width for which such pens are designed. Deviations from the vertical will vary the line width produced and the mechanical aid described herein helps insure the exact width desired.

The device simply consists of a small frame or plate with two glide-feed or rollers supporting a portion of the plate and a third support provided by the pen tip itself which is retained in an extension of the plate by a female threaded hole which mates with the threads on the pen barrel referred to above. The pen itself extends outward of the device and is easily visible for the draftsman. Since the threads are near the tip the support to pen tip distance is minimized and steadiness of the nib on the paper is increased. Pen pressure and therefore align width can easily be varied by varying downward pressure on the pen tip support. Finally, the simplicity of the device enables it to be easily grasped and used by handicapped persons or persons with limited dexterity, and in this embodiment a convenient handle for this purpose is provided as well.

Because there are a number of different pens manufactured within the type referred to above having slightly different dimensions of screw threads, barrel diameter and pen length the device herein includes means to accommodate pens of different characteristics. The extension previously referred to containing a female hole for engaging the threads on the pen barrel can be made as a removable adaptor plate to be attached to the frame or platform, typically by guide pegs and retaining nut and bolt. Thus the instrument can be supplied with a number of different interchangeable adaptor plates, each manufactured to accommodate a pen of distinct dimensions. Other adaption provisions can easily be added such as a shim between the adaptor plate and frame to increase the support to paper distance and means to raise and lower the guide feet at the other two support points.

Thus the invention described herein seeks to provide a device that will hold a modern drawing pen in a steady vertical orientation as it is moved across the drawing paper.

Another object of the within invention is to provide a penholder easily grasped by handicapped persons of limited dexterity in order to aid them in drawing or writing.

Another object of this invention is to provide a penholder which the user can operate while maintaining constant view of the pen tip.

Another object of the within invention is to provide a penholder easily adaptable to a number of different manufactures of modern drawing pens.

DESCRIPTION OF THE PREFERRED EMBODIMENT

Figure 1:
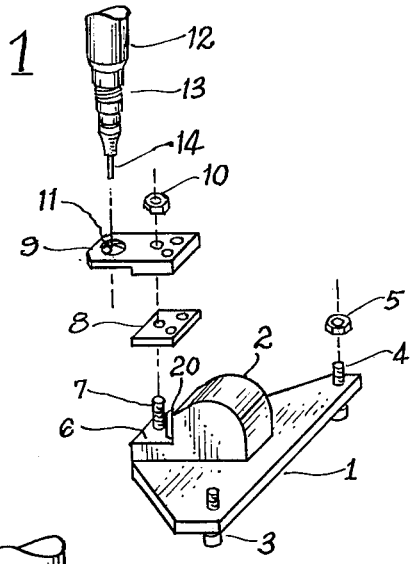
FIG. 1 is a perspective view of the penholder device illustrating the parts of the device in exploded view.

Referring to FIG. 1, the configuration and assembly of the parts in perspective view can be readily understood. A platform 1 roughly of triangular shape is attached permanently to a vertical rounded handle shape 2 for grasping the instrument. The platform in turn is supported at its two rearward points by metal glides which serve as feet which are in turn attached to the platform by a bolt shank 4 and retaining nut 5. The forward portion 6 of the platform provides an attachment base for the remaining parts of the device and protruding from the base is a retaining bolt 7. A shim plate 8 may be placed over the bolt to adjust the attachment distance between the platform and the adapter plate 9 secured to the platform via retaining nut 10. Contained within the platform is a female threaded hole 11. The drawing pen 12 to be retained is illustrated above the adapter plate ready for insertion and retention in the adapter plate. The male screw threads 13 around the pen barrel are provided by the manufacturer usually for the purpose of retaining a female threaded screw cap. Here the cap is removed and the threads themselves engage the female hole in the adapter plate and platform, and providing a third support point for the entire platform assembly to rest on the drawing paper.

Figure 2:
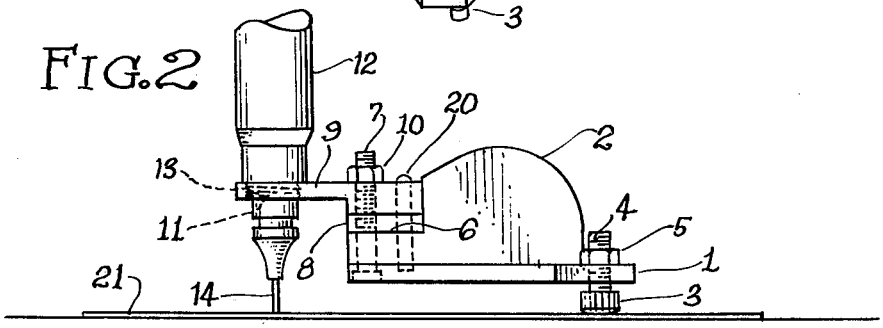
FIG. 2 is a side view of the penholder device showing the engagement of the parts and hidden line view.

FIG. 2 illustrates in side view the device as it is in use on the drawing paper. The parts of the first drawing are again illustrated and in addition a guide rod peg 20 is shown in hidden view which serves further to maintain the adapter plate in fixed position relative to the platform. The entire device rests on the paper surface 21 by the glide feet 3 at the rearward portion and the pen nib 14 at the forward portion. The user grasps the handle 2 between thumb and forefinger and draws the device across the paper leaving an ink line behind the travel of the pen nib. The pen nib is maintained in a rigid vertical position. The engagement of the female threads 11 of the adapter plate 9 with the male threads of the pen barrel 13 is shown in hidden view and can here by seen to be quite effective and substantial in clamping the pen into the device. The support point is relatively close to the paper so that wobbles of the pen tip are minimized. The retention method of using the threads on the pen can here be seen to be superior to cumbersome prior methods in the art such as set screws in a smooth hole or clamp or spring devices involving moving parts, all of which are less stable than the close fit provided by a thread attachment.

It can also be seen here that as the device may be used by a person of limited dexterity it does not require effort to maintain the vertical orientation and control of the pen. Both these features make the device easy to use and combined with the good visibility of the pentip-to-paper contact point make it especially useful for handicapped persons.

Figure 3:
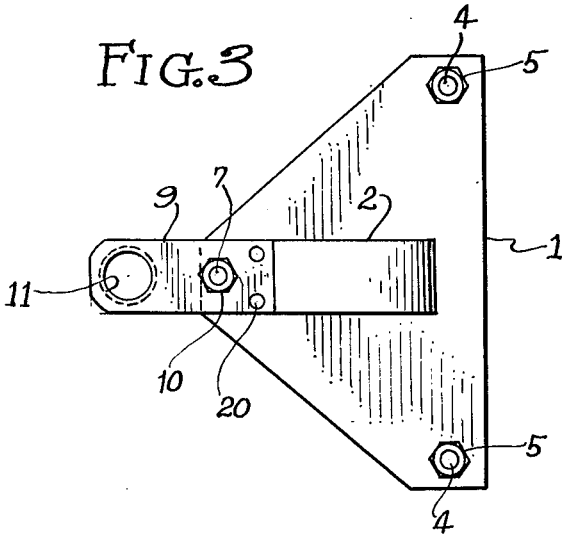
FIG. 3 is a plan view of the penholder device.

FIG. 3 finally illustrates the device in plan view showing the shape of the platform provided from a user's viewpoint. The pen is supported well forward of the main body of the device improving its visibility to the user from above, especially if the device is constructed of transparent plastic material is suggested before. The overall shape of the device conforms to the orientation of the grasping hand that is narrowing toward the forward pen containing portion and broadening toward the base for resting the palm or heel of the hand on.

It can also be seen from references to the drawings that some features of the concept could be modified without disturbing the essential function and concept of the within invention. For instance, the entire device could be made of a single unit rather than involving a replaceable adapter plate and the platform and grasping means could be constructed of an open framework or in other configurations that maintain the functional advantages described herein.

I claim:

1. A holder for a drafting pen having screw threads on the pen barrel, said holder comprising:

(a) a transparent planar, generally triangular frame plate;

(b) a pair of bearing points extending from adjacent one edge of said frame plate at two corners thereof;

(c) a generally planar adaptor plate;

(d) a mount for said adapter plate, said mount defining a flat surface disposed on the side of said frame plate opposite said one edge thereof and having an upright bolt and at least one upright peg extending upward from said flat surface;

(e) said adapter plate having a threaded pen barrel-engaging hole in one end thereof and including at least one guide hole to engage said peg and guide said adapter plate mounted into mounted relation with said frame plate and said adapter plate also having a mounting hole to receive said bolt, and including a retainer nut to retain said adapter plate on said bolt, such that when mounted said one end of said adapter plate extends beyond and generally away from said frame plate and whereby different mounting plates to accomodate different pen types may be substituted for one another in said holder with facility; and (f) at least one shim plate having holes to accomodate said pegs and bolt to space said adapter plate upward from said frame plate to accomodate pens of different tip-to-threads spacing.

* * * * *